US005438507A

United States Patent [19]

Kim et al.

[11] Patent Number: 5,438,507

[45] Date of Patent: Aug. 1, 1995

[54] METHOD OF AND APPARATUS FOR CONTROLLING WASHING OPERATION OF WASHER

[75] Inventors: Jung H. Kim, Seoul; Hyung S. Kim, Kyungki-Do; Byeong H. Lee, Kyungki-Do; Young H. Roh, Kyungki-Do; Hae Y. Chung, Seoul, all of Rep. of Korea

[73] Assignee: Goldstar Co., Ltd., Seoul, Rep. of Korea

[21] Appl. No.: 134,297

[22] Filed: Oct. 8, 1993

[30] Foreign Application Priority Data

Jun. 19, 1993 [KR] Rep. of Korea ..... 11230/1993

[51] Int. Cl.[6] ..... D06F 33/02

[52] U.S. Cl. ..... 364/140; 8/158; 8/159; 68/12.02

[58] Field of Search ..... 364/140, 400, 148–150; 8/158, 159; 68/12.02, 12.27, 12.04, 12.18, 13 A, 17 R, 12.03

[56] References Cited

U.S. PATENT DOCUMENTS

| | | | |
|---|---|---|---|
| 5,048,139 | 9/1991 | Matsumi et al. | 8/158 |
| 5,083,447 | 1/1992 | Kiuchi et al. | 68/12.02 |
| 5,129,241 | 7/1992 | Kiuchi et al. | 68/12.02 |
| 5,241,845 | 9/1993 | Ishibashi et al. | 68/12.02 |
| 5,291,626 | 3/1994 | Molnar | 8/158 |

*Primary Examiner*—Roy N. Envall, Jr.
*Assistant Examiner*—Steven R. Garland
*Attorney, Agent, or Firm*—Ostrolenk, Faber, Gerb & Soffen

[57] ABSTRACT

A method of and an apparatus for controlling a washing operation of a washer wherein a correlation coefficient is derived from data indicative of a turbidity of a washing water. The correlation coefficient is compared with reference data experimentally obtained, for determining all information required to control the washer such as the kind of a detergent used, an amount of the detergent, a washing time and a water flow intensity. The method includes a first procedure of checking an operation mode of the washer selected by a user, a second procedure of starting a washing operation when the operation mode checked is a washing mode, sampling, at predetermined time intervals, turbidity data supplied from turbidity sensing means equipped in the washer until the washer starts to operate at a stable state, and stores the turbidity data sampled, a third procedure of analyzing the turbidity data stored at the second procedure and operating a correlation coefficient of the turbidity data; and a fourth procedure of comparing the correlation coefficient operated at the third procedure with reference data and determining various information required to control the washer, based on the result of the comparison.

8 Claims, 7 Drawing Sheets

METHOD OF AND APPARATUS FOR CONTROLLING WASHING OPERATION OF WASHER

BACKGROUND OF THE INVENTION

1. Field of the Invention

The present invention relates to a washer, and more particularly to a method of and an apparatus for controlling a washing operation of a washer.

2. Description of the Prior Art

FIG. 1 is a block diagram of a conventional apparatus for controlling a washing operation of a washer. As shown in FIG. 1, the control apparatus includes a water level sensing unit 1 for sensing an amount of a water supplied in a washing tub of the washer, a turbidity sensing unit 2 for sensing the turbidity of a washing water contained in the washing tub, and a clothes sensing unit 3 for sensing an amount of clothes. A microprocessor 4 is connected to all the sensing units 1, 2 and 3. The microprocessor 4 serves to compare data sensed by the sensing units 1, 2 and 3 with corresponding reference data, determine various information required to control the washer such as a washing time, the kind of a detergent, a detergent amount and a water flow intensity, and outputs the determined information. Connected to the microprocessor 4 are a storing unit 5 for storing reference data experimentally obtained and a display unit 6 for displaying a condition of the washer operated in an operation mode selected by a user. A switching unit 7 is also connected to the microprocessor 4. The switching unit 7 outputs control signals for actuating a motor 8, a water supply valve 9 and a water drain valve 10 under a control of the microprocessor 4.

As shown in FIG. 2, the turbidity sensing unit 2 includes a D/A converter 21 adapted to convert a control signal PWM outputted from the microprocessor 4 into an analog signal. To the output of the D/A converter 21, a transistor 22 is coupled which is activated by the analog signal from the D/A converter 21. A diode 23 is connected to the input of the transistor 22. When the transistor 22 turns on, the diode 23 becomes a conductive state and thus emits light. A transistor 24 is also provided which receives the light emitted from the diode 23 via a polluted washing water. To the output of the transistor 24, an A/D converter 25 is coupled which converts the amount of received light into a digital signal. The digital signal is sent to the microprocessor 4.

The amount of light received in the transistor 24 is varied depending on the turbidity of the washing water. The diode 23 is a photosensor for converting a light into an electrical signal.

As the user selects an operation mode of the washer using the display unit 6, a corresponding mode signal is fed to the microprocessor 4. Thereafter, when the microprocessor 4 receives data indicative of the current condition of the washer, from the water level sensing unit 1, the turbidity sensing unit 2 and the clothes amount sensing unit 3, it compares the received data with reference data.

The results of the comparison achieved in the microprocessor 4 are sent to the motor 8, the water supply valve 9 and the water drain valve 10 via the switching unit 7, respectively. Accordingly, the motor 8, the water supply valve 9 and the water drain valve 10 via the switching unit 7 are actuated according to the comparison results, respectively.

For instance, when a washing mode signal is received in the microprocessor 4, it is then outputted as a control signal PWM from the microprocessor 4. The control signal PWM is converted into an analog signal through the D/A converter 21. The analog signal is then applied to the transistor 22, thereby causing the transistor 22 to turn on.

As the transistor 22 turns on, the diode 23 emits a light which is, in turn, fed to the transistor 24 via the washing water.

The amount of light received in the transistor 24 is varied depending on the turbidity of the washing water and converted into a digital signal through the A/D converter 25. The digital signal is then fed to the microprocessor 4.

From the received light amount, a turbidity of the washing water is determined. Data indicative of the turbidity of the washing water is compared with reference data stored in the storing unit 5. This comparison is continued until the washer starts to operate at a stable state after an initiation of washing operation. From the results of the comparison, various information required to control the washer is determined which includes a washing time, the kind of a detergent, a detergent amount, a water flow intensity.

A turbidity ascent curve, which represents turbidity of the washing water for a period from a washing initiation point t1 to a point of time when the washer starts to operate at a stable state, is variously depicted according to the kinds of materials polluting the washing water, the kind of detergent, and a temperature of the washing water, as indicated by curves a, b and c in FIG. 3. As a result, the turbidity data has a complex characteristic.

However, the conventional washer does not take into consideration such complex turbidity data, thereby involving a high possibility of a malfunction.

In determining the kind of detergent, the conventional washer compares turbidity data sensed when a predetermined time elapses after an initiation of the washing operation, with reference data so that a liquid detergent i s determined when the turbidity data is not less than the reference data, whereas a powder detergent is determined when the turbidity data is less than the reference data. Although such a determination enables a selected use of the liquid detergent and the powder detergent, it makes it impossible to determine a detergent to be used, in terms of the manufacturer. As a result, the kind of detergent may be erroneously determined. Such an erroneous determination results in a problem that the detergent is used in an excessive amount or an insufficient amount.

SUMMARY OF THE INVENTION

Therefore, an object of the invention is to provide a method of and an apparatus for controlling a washing operation of a washer capable of preventing a malfunction of the washer, improving a detergency, and reducing a damage and a twist of clothes, by analyzing data indicative of a complex turbidity of a washing water, operating a correlation coefficient of the turbidity according to the result of the analysis, comparing the correlation coefficient with reference data, determining all information required to control the washer according to the result of the comparison.

Another object of the invention is to provide a method of and an apparatus for controlling a washing operation of a washer wherein the kind of a detergent to be used is determined in terms of the detergent manufacturer so as to accurately determine the amount of detergent to be used, thereby minimizing an environmental pollution and reducing a washing time.

In accordance with one aspect, the present invention provides an apparatus for controlling a washing operation of a washer comprising: turbidity sensing means for sensing a turbidity of a washing water and generating data indicative of said turbidity sensed; correlation coefficient operating means for analyzing said turbidity data and operating a correlation coefficient of the turbidity data; and a microprocessor for comparing said correlation coefficient supplied from said correlation coefficient operating means with reference data and determining various information required to control said washer.

In accordance with another aspect, the present invention provides a method for controlling a washing operation of a washer comprising the steps of: (A) checking an operation mode of said washer selected by a user; (B) starting a washing operation when said operation mode checked is a washing mode, sampling, at predetermined time intervals, turbidity data supplied from turbidity sensing means equipped in the washer until the washer starts to operate at a stable state, and storing said turbidity data sampled; (C) analyzing the turbidity data stored at said step (B) and operating a correlation coefficient of the turbidity data; and (D) comparing said correlation coefficient operated at said step (C) with reference data and determining various information required to control the washer, based on the result of said comparison.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
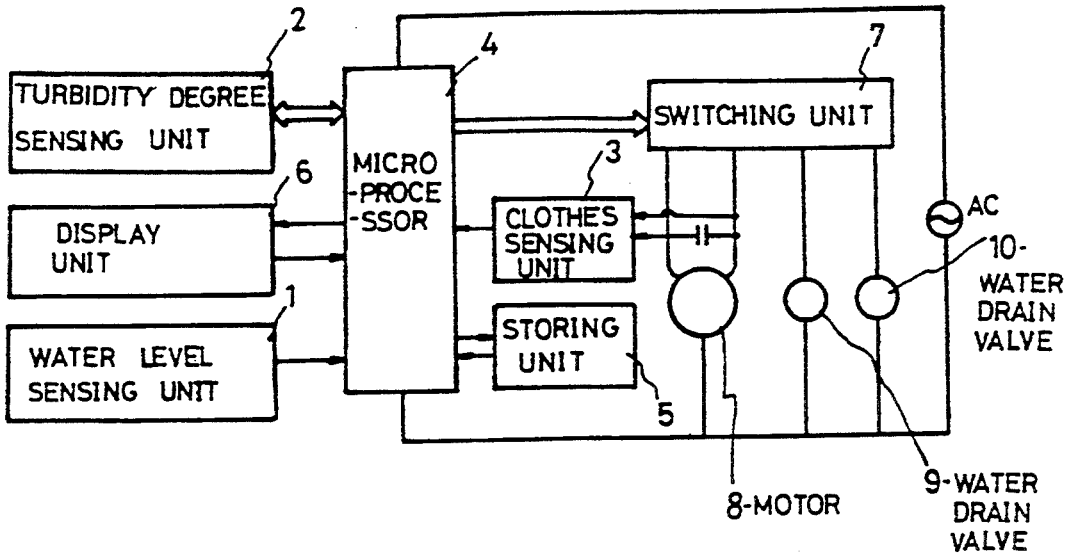
FIG. 1 PRIOR ART
FIG. 1 is a block diagram of a conventional apparatus for controlling a washing operation of a washer.
Figure 2:
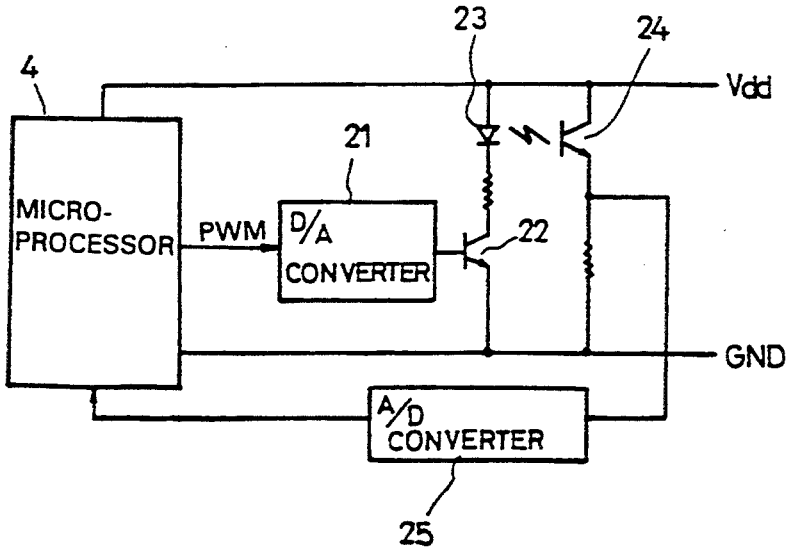
FIG. 2 PRIOR ART
FIG. 2 is a circuit diagram of a polluted degree sensing unit of the conventional washing controlling apparatus shown in FIG. t1.
Figure 3:
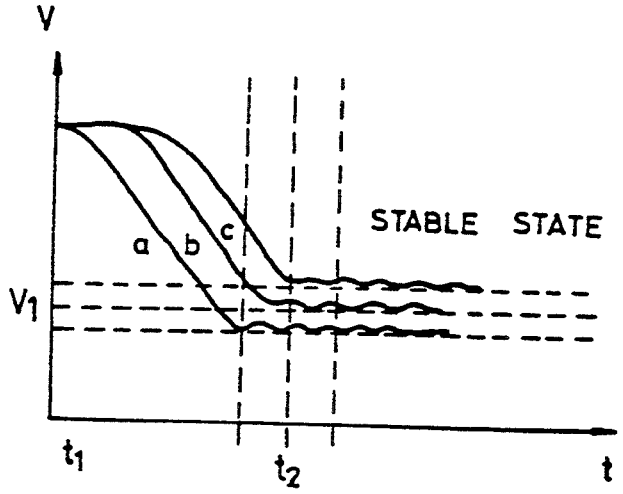
FIG.3 PRIOR ART
FIG. 3 illustrates turbidity ascent curves obtained in the conventional apparatus shown in FIG. 1.
Figure 4:
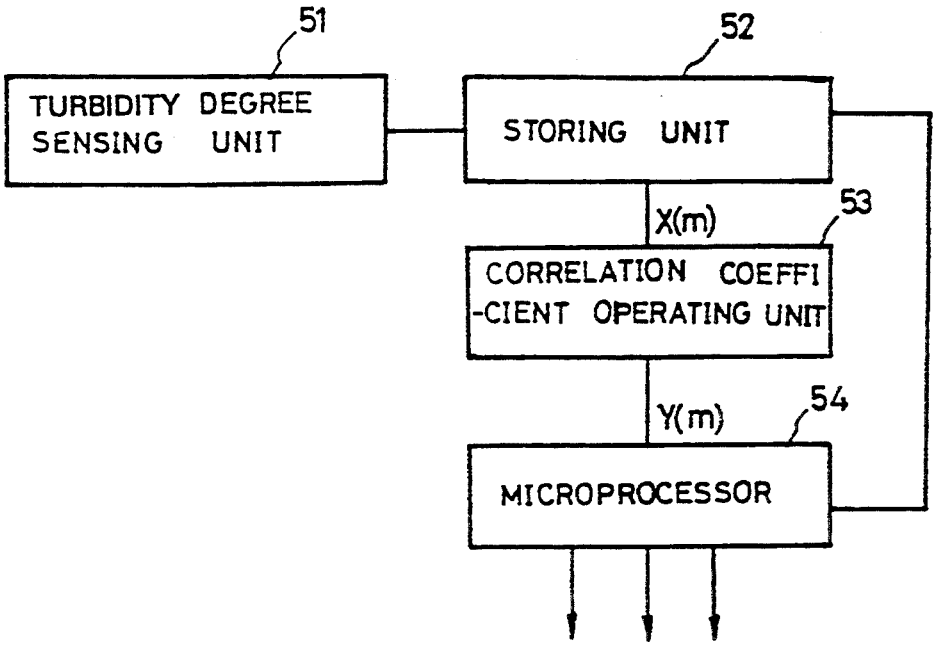
FIG. 4 is a block diagram illustrating an apparatus for controlling a washing operation of a washer in accordance with the present invention.

FIG. 4 is a block diagram illustrating an apparatus for controlling a washing operation of a washer in accordance with the present invention.

As shown in FIG. 4, the washing control apparatus includes a turbidity sensing unit 51 for sensing a turbidity of a washing water and generating data about the sensed turbidity. To the turbidity sensing unit 51, a storing unit 52 is connected which samples, at predetermined time intervals, the turbidity data supplied from the turbidity sensing unit 51 until the washer operates at a stable state, and stores the sampled turbidity data. A correlation coefficient operating unit 53 is connected to the storing unit 52. The correlation coefficient operating unit 53 serves to analyze the turbidity data supplied from the storing unit 52 and operates a correlation coefficient of the turbidity data. To the correlation coefficient operating unit 53, a microprocessor 54 is connected which serves to compare the correlation coefficient obtained by the correlation coefficient operating unit 53 with reference data and determine all information required to control the washer such as a washing time, a detergent amount and a water flow intensity, based on the result of the comparison.

Figure 5:
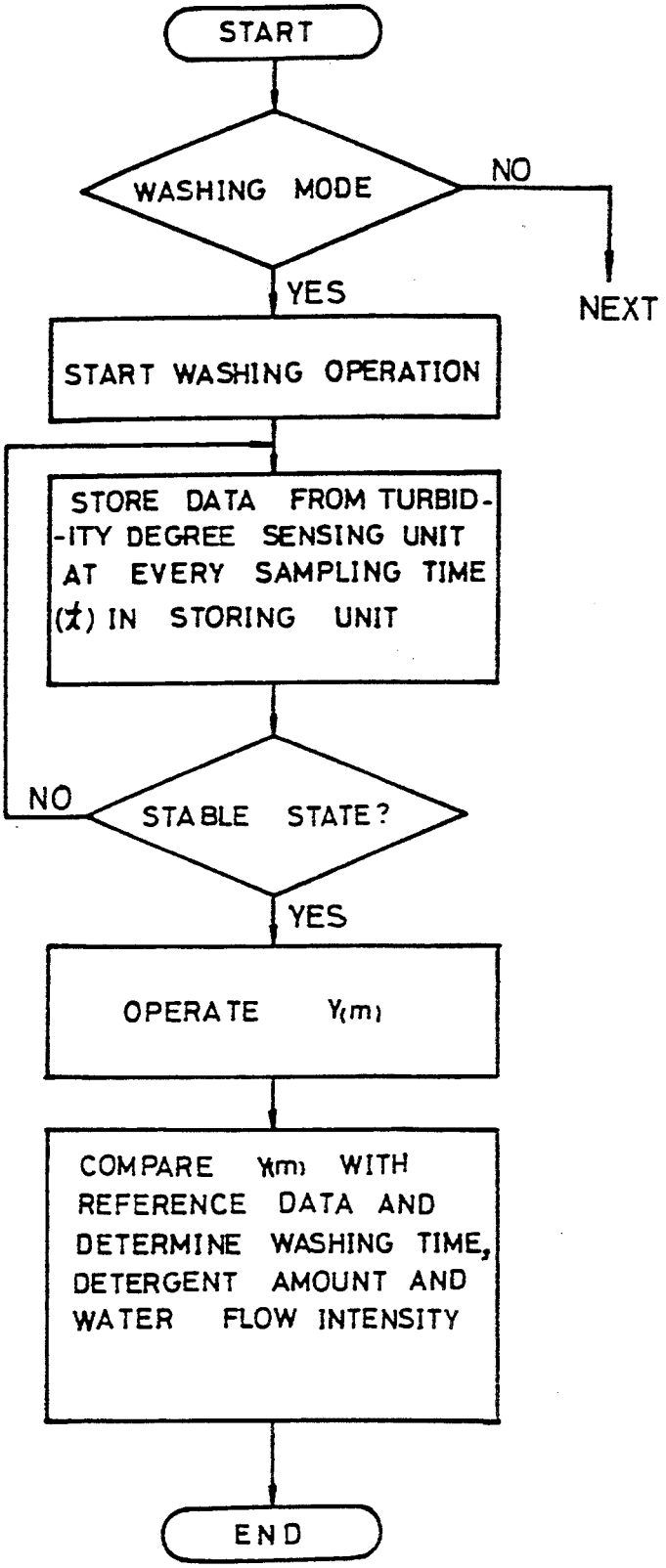
FIG. 5 is a flow chart illustrating a method for controlling a washing operation of a washer in accordance with an embodiment of the present invention.

FIG. 5 i s a flow chart illustrating a method for controlling a washing operation of a washer in accordance with an embodiment of the present invention.

As shown in FIG. 5, the washing controlling method comprises a first procedure of checking an operation mode of the washer selected by the user and a second procedure of starting a washing operation when the checked operation mode is a washing mode, sampling, at predetermined time intervals, turbidity data supplied from a turbidity sensing unit until the washer operates at a stable state, and stores the sampled turbidity data. The washing controlling method further comprises a third procedure of analyzing the turbidity data stored at the second procedure and operating a correlation coefficient of the turbidity data, and a fourth procedure of comparing the correlation coefficient operated at the third procedure with reference data and determining a washing time, a detergent amount and a water flow intensity, based on the result of the comparison.

Figure 6:
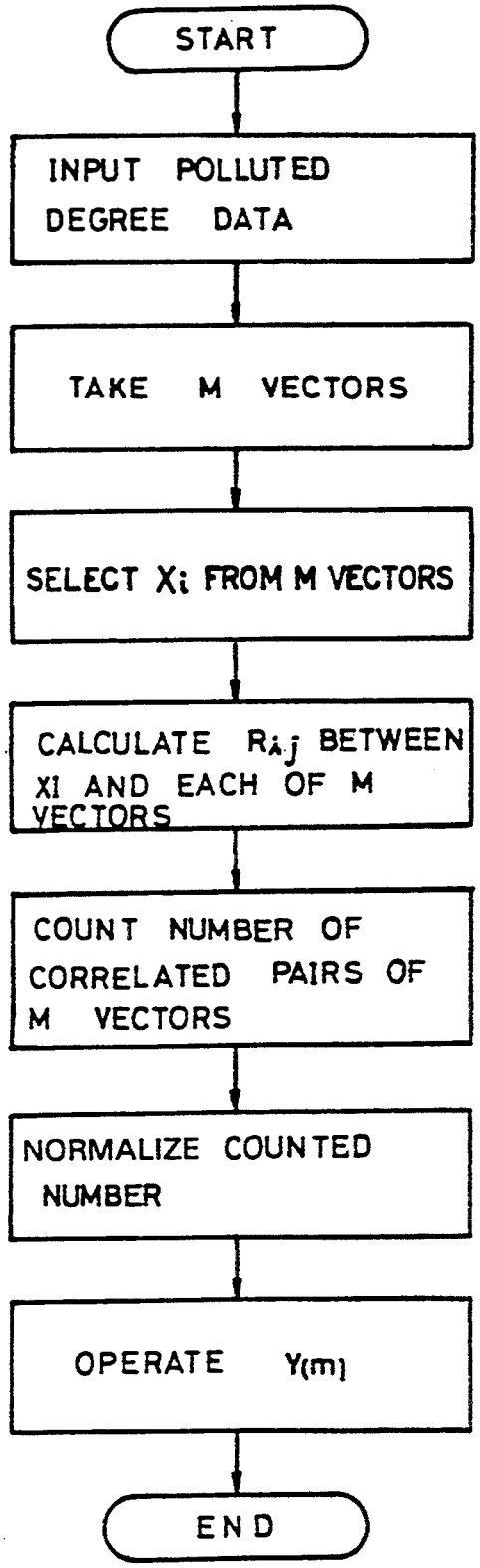
FIG. 6 is a flow chart illustrating a third procedure of the washing controlling method of FIG. 5.

As shown in FIG. 6, the third procedure of the washing controlling method comprises a first step of reading the turbidity data X(m) sampled at the second procedure, a second step of deriving M vectors from the turbidity data X(m) read at the first step, and a third step of selecting a reference vector Xi from the M vectors derived at the second step. The third procedure further comprises a fourth step of operating a distance Rij between the reference data Xi selected at the third step and other data Xj, a fifth step of determining the vectors Xi and Xj to have a correlation when the distance Rij derived at the fourth step is less than a predetermined distance index di, counting the number of correlated vectors Ndi, and normalizing the counted number of correlated vectors Ndi to be one of a maximum value Dmax, a minimum value Dmin, and other values optionally predetermined, and incrementing the distance index di, and a sixth step of depicting a graph having a X-axis indicative of the distance index di and a Y-axis indicative of the counted number Ndi, determining appropriate inflection points of the graph, calculating a slope of a line connecting the inflection points, and outputting the calculated slope as the correlation coefficient of the polluted degree data.

Functions and effects of the washing controlling apparatus and method will now be described, in conjunction with the annexed drawings.

Turbidity data is generated by the turbidity sensing unit 51 which senses an amount of light received therein, converts the sensed light amount into an electrical signal, to generate data indicative of a turbidity of a washing water. The turbidity data has a variety and a complexity, depending on the polluted form of the washing water, the kind of a detergent and the temperature of the washing water.

Such various and complex turbidity data are sampled through the storing unit 52 at predetermined time intervals. The storing of turbidity data is repeated until the washer operates in a stable state.

The stable state of the washer means a state that the turbidity data becomes V1 at a time point t2 when the turbidity data is decreased no longer.

The turbidity data stored in the storing unit 52 is analyzed through the correlation coefficient operating unit 53 which, in turn, calculates the correlation coefficient of the turbidity data.

For carrying out such an analysis, first, the turbidity data is selected, based on a given embedding dimension ED and a delay time DL.

This procedure will be described in conjunction with an example of an embedding dimension ED=1 and a delay time DL=$\tau$=t.

Assuming that an initial value of the inputted turbidity data X(n) is X(t0), the initial data X(t0) is fed to the storing unit 52. Turbidity data which are continuously inputted one by one at every delay time $\tau$ are applied to the storing unit 52.

Namely, the initial turbidity data X(t0) is first stored in the storing unit 52. Then, turbidity data X(t0+t) is stored in the storing unit 52 at the delay time t0+t. The turbidity data X(t0) and X(t0+t) are then outputted from the storing unit 52.

With the outputted turbidity data X(t0) and X(t0+t), the correlation coefficient operating unit 53 calculates a distance R11 between the two turbidity data X(t0) and X(t0+t). At this time, the embedding dimension ED is 1 and the delay time $\tau$ is t. Accordingly, the distance R11 can be obtained from an operation using the following equation:

$$R11=|X(t0)-X(t0+t)\uparrow.$$

The calculated distance R11 is outputted under a condition that it has been normalized to be one of a maximum value Dmax, a minimum value Dmin, and other values, all of the values being optionally predetermined.

The distance R11 is then applied to the microprocessor 54 which, in turn, compares the inputted distance R11 with the previously stored distance index di and increments the distance index di by one when the condition of R11>di is satisfied, to obtain an incremented distance index dj.

Namely, the incremented distance index dj satisfies the following equation (2):

$$dj=di+1 \qquad (2).$$

The above procedure is performed for the delay time t. The storing unit 52 outputs turbidity data X(t0+2 t) stored therein at the next delay time 2 t. Based on the turbidity data X(t0+2 t) and the initial turbidity data X(t0), the correlation coefficient operating unit 53 operates a distance R12 between the two polluted degree data.

The outputted distance R12 is compared with the previously stored distance index dj. When the compared result satisfies the condition of R12>dj, the distance index dj is incremented.

The above procedures are repeated with respect to all turbidity data received with the lapse of delay time. When the number of turbidity data Ndj, which is present in a circle having a diameter corresponding to the incremented distance index dj, reaches the predetermined final number Dmax, a selection is made for distance indexes di and dj having an appreciable inflection point in a graph which represents the number of turbidity data Ndj present in the circle.

The inflection point may be selected based on the distance indexes di and dj previously set. Otherwise, the user may set the inflection point at outside.

Where distance indexes have been previously set, in order to derive the inflection point, a distance index is selected from optional distance indexes di and dj. A search is made for a distance index which satisfies the minimum distance from a line connecting the selected distance index and the other distance index. Once the distance index is found, a procedure for deriving the inflection point based on setting the found distance index point to determine an appreciable inflection point. Where the distance index is determined at outside, an optimum inflection point derived experimentally is determined from outside.

Where a X-Y coordinate plane is made by an axis d-axis indicative of the distance index and an axis Nd indicative of the number of turbidity data being present in a circle with a diameter equivalent to the distance index, the inflection point determined as above is used to calculate a slope resulted from the incremented number of turbidity data.

At this time, the slope is calculated by using the following equation (3):

$$\text{Slope}=[\log(Ndj)-\log(Ndi)]/[\log(dj)-\log(di)] \qquad (3)$$

The calculated slope is the correlation coefficient of turbidity data, namely, a final output Y(i) of the correlation coefficient operating unit 53.

The correlation coefficient of turbidity data, which is obtained on the assumption that the embedding dimension ED is 1, and the delay time DL is t, refers to as a correlation coefficient according to a pointwise method.

Where the embedding dimension ED and the delay time DL (DL=$\tau$) are assumed as m and t p, respectively, a vector Xi of the turbidity data at the time t0 is outputted from the storing unit 52 for the time (m−1)p t.

The vector Xi of the turbidity data can be expressed by the following equation:

$$Xi=[X(t0), X(t0+p\ t), \ldots, X(t0+(m-1)p\ t)]$$

wherein, p represents a positive multiple, and i and j represent embedding dimensions.

Also, a vector Xj of the polluted degree data at the time t0+t is outputted from the storing unit 52 for the time mp t. The vector Xj can be expressed by the following equation:

$$Xj=[X(t0+t), X(t0+(p+1)\ t), \ldots, X(t0+mp\ t)].$$

The distance value Rij calculated from the above polluted degree data vectors is |Xj -Xi↑. The calculated distance Rij is then compared with a distance index meeting a given distance condition so that the number of turbidity data corresponding to the distance index is counted.

That is, where the distance Rij between two vectors Xi and Xj is less than the distance index, the vectors Xi and Xj are determined to have a correlation. In this case, all turbidity data present in the distance index are counted in an accumulated manner.

Using the distance index and the number of polluted degree data, a graph is then depicted on a X-Y coordinate plane having an axis d-axis indicative of the distance index and an axis Nd indicative of the number of turbidity data being present in a circle with a diameter equivalent to the distance index. From the graph, appropriate inflection points are determined. Thereafter, a slope of a line connecting the inflection points is calculated. At this time, the slope is calculated by using the above-mentioned equation (3).

The calculated slope is the correlation coefficient of polluted degree data, namely, a final output Y(i) of the correlation coefficient operating unit 53.

Figure 7:
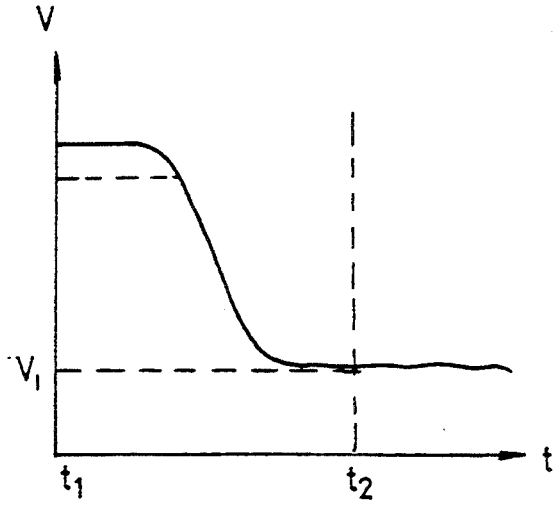
FIG. 7 is a graph illustrating correlation coefficients obtained according to the present invention.

FIG. 7 is a graph illustrating final correlation coefficients outputted from the correlation coefficient operating unit 53.

The obtained correlation coefficient Y(m) is compared with reference data experimentally obtained through the microprocessor 54. According to the result of the comparison, the microprocessor 54 determines all information required to control the washer such as a washing time, a detergent amount and a water flow intensity.

Figure 8:
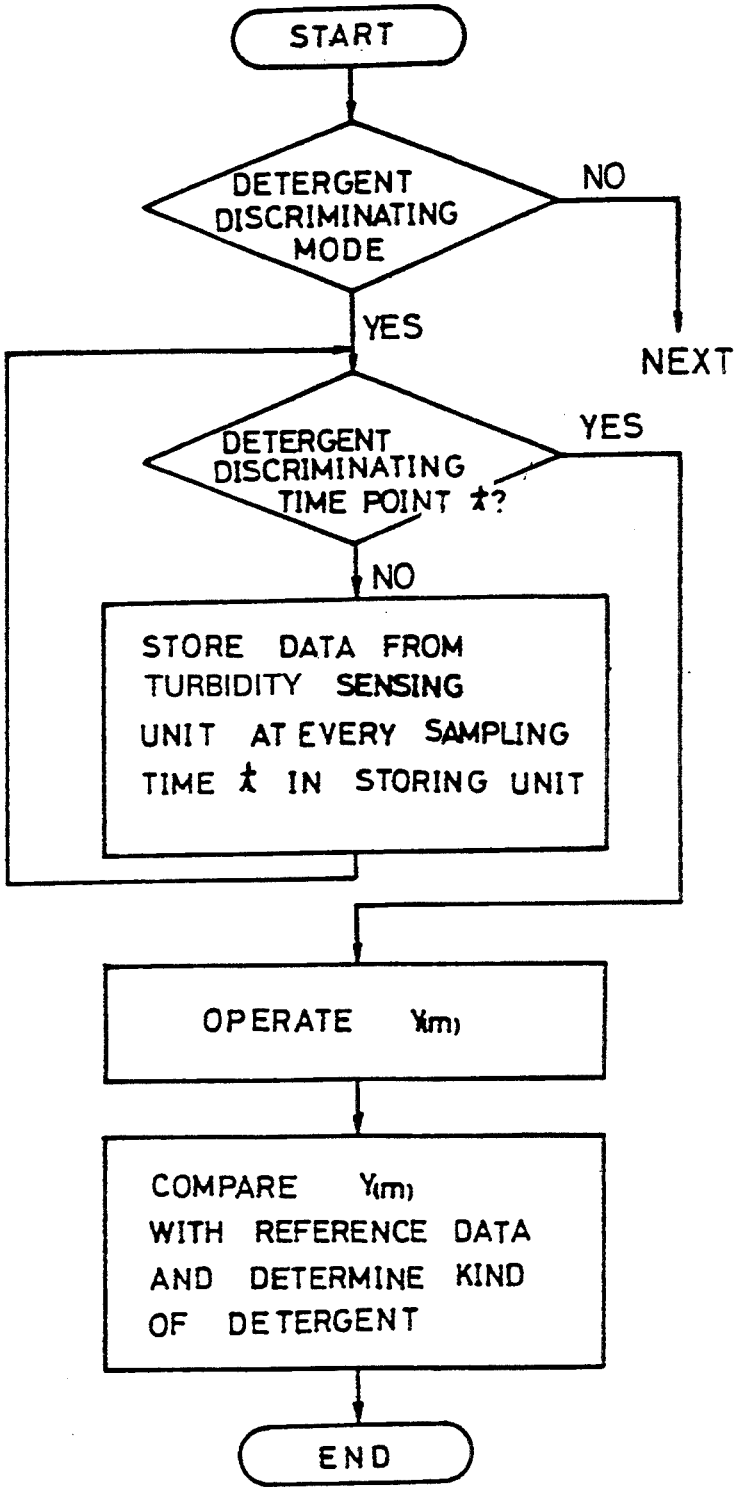
FIG. 8 is a flow chart illustrating a procedure of the washing controlling method which is employed when the washer operates in a detergent discriminating mode, in accordance with the present invention.

FIG. 8 is a flow chart illustrating a procedure of the washing controlling method which is employed when the washer operates in a detergent discriminating mode, in accordance with the present invention.

In accordance with the method, first, a determination is made whether the current point of time during an operation in a washing mode corresponds to a point of time for initiating an operation in a detergent discriminating mode. If the current point of time has not reached the point of time for initiating the detergent discriminating mode operation yet, turbidity data inputted through the polluted degree sensing unit 51 are sampled at predetermined time intervals. The sample turbidity data are stored in the storing unit 52.

When the current point of time has reached the point of time for initiating the detergent discriminating mode operation, the turbidity data stored in the storing unit 52 are applied to the correlation coefficient operating unit 53 which, in turn, operates a correlation coefficient.

In the microprocessor 53, the correlation coefficient of polluted degree data is compared with the reference data previously stored. According to the result of the comparison, the kind of a detergent is determined, in terms of the detergent manufacturer. Based on the determined detergent kind, a detergent amount to be used is determined.

Figure 9:
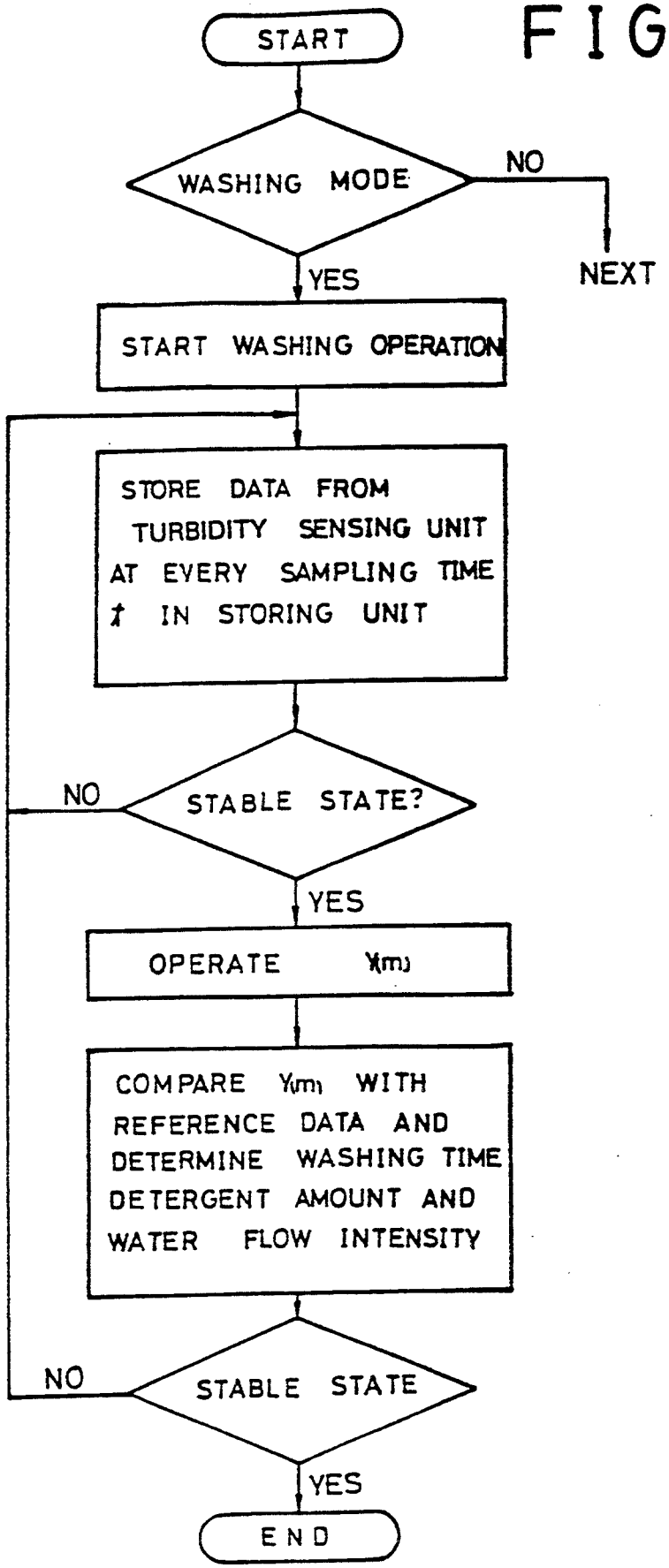
FIG. 9 is a flow chart of a method for controlling a washing operation of a washer in accordance with another embodiment of the present invention.

FIG. 9 is a flow chart of a method for controlling a washing operation of a washer in accordance with another embodiment of the present invention.

In accordance with this method, for turbidity data outputted from the turbidity sensing unit 51, their correlation coefficients are operated at predetermined time intervals. Each of correlation coefficients is compared with reference data stored so as to determine a washing time, a detergent amount and a water flow intensity.

The above procedures are repeated until the washer operates at a stable state. When the washer starts to operate at the stable state, the determined information is outputted from the microprocessor 54.

As apparent from the above description, the present invention provides a method of and an apparatus for controlling a washing operation of a washer wherein a correlation coefficient is derived from data indicative of a turbidity of a washing water. The correlation coefficient is compared with reference data so as to determine all information required to control the washer such as the kind of a detergent used, an amount of the detergent, a washing time and a water flow intensity. The determined information makes it possible to accurately analyze various and complex turbidity data. As a result, it is possible to prevent a malfunction of the washer, improve a detergency, and reduce a damage and a twist of clothes. Moreover, the kind of a detergent is determined in terms of the detergent manufacturer so as to accurately determine a detergent amount, in accordance with the present invention. This makes it possible to minimize an environmental pollution and reduce a washing time.

Although the preferred embodiments of the invention have been disclosed for illustrative purposes, those skilled in the art will appreciate that various modifications, additions and substitutions are possible, without departing from the scope and spirit of the invention as disclosed i n the accompanying claims.

What is claimed is:

1. A method for controlling a washing operation of a washer comprising the steps of:

(A) checking an operation mode of said washer selected by a user;

(B) starting a washing operation when said operation mode checked is a washing mode, sampling, at predetermined time intervals, turbidity data supplied from polluted degree sensing means equipped in the washer until the washer starts to operate at a stable state, and storing said turbidity data sampled;

(C) analyzing the turbidity data stored at said step (B) and deriving a correlation coefficient of the turbidity data; and (D) comparing said correlation coefficient operated at said step (C) with reference data and determining various information required to control the washer, based on the result of said comparison.

2. The method of claim 1, wherein the stable state is the state in which no decrease in the turbidity data is sensed.

3. The method of claim 1, wherein step (C) includes the steps of:

(a) applying the stored sampled data to a microprocessor until the sampled data reaches the stable state;

(b) applying the stored sampled data to a correlation coefficient operating means while step (a) is in progress;

(c) computing the correlation coefficient from the sampled data; and (d) outputting the computed correlation coefficient to the microprocessor.

4. The method of claim 1, wherein step (C) includes the steps of:

(a) applying the stored sampled data to microprocessor until the sampled data reaches the stable state;

(b) applying the stored sample data to a correlation coefficient operating means when step (a) is completed;

(c) computing the correlation coefficient from the sample data; and (d) outputting the computed correlation coefficient to the microprocessor.

5. A method for controlling a washing operation of a washer comprising the steps of:

(A) checking an operation mode of said washer selected by a user;

(B) starting a washing operation when said operation mode checked is a washing mode, sampling, at predetermined time intervals, turbidity data supplied from turbidity sensing means equipped in the washer until the washer starts to operate at a stable state, and storing said turbidity data sampled; and (C) analyzing the turbidity data stored at said step (B) and deriving a correlation coefficient of the turbidity data; and (D) comparing said correlation coefficient derived in said step (C) with reference data and determining various information required to control the washer, based on the result of said comparison, wherein step (C) comprises the steps of:

(a) reading the turbidity data sampled at said step (B);

(b) deriving a predetermined number of vectors from said polluted degree data read at said step (a);

(c) selecting a reference vector from said predetermined number of vectors derived at said step (b);

(d) determininq a distance between the reference vector selected at said step (c) and each of other vectors;

(e) counting the number of vectors, whose distance determined at step (d) is shorter than a predetermined distance index; and (f) making a graph by depicting the number of vectors whose distance determined at step (d) is shorter than a predetermined distance index while changing the distance index in an X-Y plane, the X-axis indicative of the distance index and the Y-axis indicative of the number of vectors;

(g) calculating a slope of the graph obtained at step (f);

(h) outputting a correlation coefficient corresponding to the slope calculated at step (g); and (i) comparing said correlation coefficient derived in said step (C) with reference data and determining various information required to control the washer, based on the result of said comparison.

6. A method for controlling a washing operation of a washer comprising of the steps of:

(A) checking an operation mode of said washer selected by a user;

(B) starting a washing operation when said operation mode checked is a washing mode;

(C) checking whether the current point of time corresponds to a point of time for initiating an operation in a detergent discriminating mode, when the current operation mode is a washing mode;

(D) sampling turbidity data outputted from a turbidity sensing means at predetermined time intervals and storing said turbidity data sampled, when the current point of time has not reached said point of time for initiating the detergent discriminating mode operation yet, and deriving a correlation coefficient of said polluted degree data stored, when the current point of time has reached the point of time for initiating the detergents discriminating mode operation; and (E) comparing said correlation coefficient of the turbidity data with said reference data and determining an amount of a detergent to be used, based on the result of said comparison.

7. A method for controlling a washing operation of a washer comprising the steps of:

(A) checking an operation mode of said washer selected by a user;

(B) starting a washing operation when said operation mode checked is a washing mode, sampling, at predetermined time intervals, turbidity data sensed by polluted degree sensing means equipped in the washer, and storing said turbidity data sampled;

(C) analyzing the turbidity data stored at said step (B) and deriving a correlation coefficient of the turbidity data; and (D) comparing said correlation coefficient derived at said step (C) with reference data previously stored and determining all information required to control the washer, based on the result of said comparison; and (E) checking whether the washer has reached a stable state and outputting said information determined at said step (D) when the washer has reached said stable state.

8. An apparatus for controlling a washing operation of a washer comprising;

a microprocessor;

a motor;

driving means for driving the motor under the control of the microprocessor;

turbidity sensing means for sensing turbidity data of the washing water in the washer under control of the microprocessor;

storing means for sampling at predetermined intervals turbidity data sensed by the turbidity sensing means and storing the sampled data; and correlation coefficient operating means for calculating correlation coefficients from the sampled data;

wherein said microprocessor stores experimentally decided correlation coefficients and driving patterns corresponding to the correlation coefficients, and then outputs a driving pattern to the driving means corresponding to a correlation coefficient inputted from the correlation coefficient operating means.

* * * * *